United States Patent [19]

Roesch

[11] Patent Number: 4,972,961

[45] Date of Patent: Nov. 27, 1990

[54] MULTIPLE-GARMENT HANGER

[76] Inventor: Wilhelm Roesch, Hinzbecker Löh 30, 4300 Essen 15, Fed. Rep. of Germany

[21] Appl. No.: 436,050

[22] Filed: Nov. 13, 1989

[30] Foreign Application Priority Data

Jul. 5, 1989 [DE] Fed. Rep. of Germany ... 8908193[U]

[51] Int. Cl.[5] ..... A47F 5/00

[52] U.S. Cl. ..... 211/116; 211/118

[58] Field of Search ..... 211/113, 116, 118, 94.5; 223/85, 95, 88

[56] References Cited

U.S. PATENT DOCUMENTS 4,366,909 1/1983 Fahmi ..... 211/116

4,771,899 9/1988 Benedict et al. ..... 211/94 X

FOREIGN PATENT DOCUMENTS 7904229 12/1979 Netherlands ..... 211/118

*Primary Examiner*—Robert W. Gibson, Jr.

*Attorney, Agent, or Firm*—Herbert Dubno

[57] ABSTRACT

A multiple-garment hanger with hooks pivotal at the ends of a support bar has guide rails projecting to one side of the support bar on which sliders are shiftable and carry respective garment-carrying rods so that the latter are simultaneously spaced from the guide rails and can be displaced to the opposite side of the support member for application of a garment or its removal.

20 Claims, 2 Drawing Sheets

MULTIPLE-GARMENT HANGER

FIELD OF THE INVENTION

My present invention relates to a multiple-garment hanger and, more particularly, to a hanger of the type in which a pair of hooks are swingably mounted at ends of an elongated support so that the support, e.g. a bar, can be suspended from a closet rod or the like and, upon release of one of the hooks, can hang down to minimize the space required for a number of garments carried by the support bar. More particularly, the invention relates to a hanger of this type which is provided with garment-carrying rod spaced along the bar and which are shiftable transversely to the support bar.

BACKGROUND OF THE INVENTION

A multiple-garment hanger of the aforedescribed type generally can have five garment-carrying rods so that respective pairs of trousers or other garments can be placed over these rods and, upon release of one of the hooks from the closet rod, can have the garments lie in close relation as the support bar hangs substantially vertically.

The garment-carrying rods in the prior art arrangement of this type, while being slidable relative to the support bar transversely of the latter, are of U-shaped configuration so that upon the hanging of a garment on a rod or removal of a garment from a rod, there is a certain degree of interference with the garment-carrying rods with the result that usually additional garments are removed or interfere with the emplacement of a garment on the rod. The fork-shaped garment-carrying rods are indeed pivotally mounted on the support bar, but do not significantly prevent the interference described above.

In German utility Model No. DE GM 87 12 870, a clothes hanger is described and illustrated which has a plurality of U-shaped garment-carrying rods which telescopingly are shiftable in the support member provided with the two hooks so as to move horizontally and so as to allow a swinging movement in the support member.

With this system, the desired garment-carrying rod can be drawn out of the garment-storage position to allow a garment to be applied to the rod without interference or to allow a garment to be removed without interference and without simultaneous removal of other garments. The garment-carrying rod can thus be returned to its original position with or without a pair of trousers or other garment.

Because of the arrangement of a number of garment-carrying rods with respective garments in this system, the entire system remains in equilibrium so that the multiple-garment hanger as a whole is easy to handle. By releasing one of the two hooks, the entire multi-garment hanger can be brought into a position in which the space requirements are reduced, the support bar which lies parallel to the closet rod hanging then substantially in an upright position.

Because of the U-shaped configuration of the garment-carrying rods in the latter construction, the upper limb of the garment-carrying rod is slidable in the support bar so that when one of the rods is drawn out for removal or hanging of a garment, it can engage other garments so that use of the hanger can be interfered with. This is especially a problem with voluminous garments such as lined trousers.

OBJECTS OF THE INVENTION

It is, therefore, the principal object of the present invention to provide an improved multi-garment hanger whereby the drawbacks of earlier systems are avoided and space-saving advantages are retained.

Another object of the invention is to provide a garment hanger which allows garments to be hung up thereon without interference and to be subsequently removed, which is easily handled and which has the space-saving advantages of the systems described earlier.

SUMMARY OF THE INVENTION

These objects and others which will become more readily apparent hereinafter are attained, in accordance with the present invention, in a multi-garment hanger which comprises:

an elongated support;

respective hooks connected to opposite ends of the support for suspending the support from a member engageable by at least one of the hooks;

a plurality of guide rails affixed to the support between the hooks and projecting to one side of the support, the guide rails being spaced apart along the support and extending transversely thereto;

a respective slider received on each of the rails and shiftable therealong; and a respective garment-carrying rod affixed to each of the sliders and shiftable therewith relative to the respective guide rail and the support transversely of the support, the garment-carrying rods being spaced from the respective guide rails by the respective sliders.

According to the invention, therefore, the support bar has a plurality of guide rails projecting therefrom at one side of the support bar and defining the sliding displacement extension of the respective garment-carrying rods which are mounted on the guide rails by respective sliders which simultaneously form spacers holding the garment-carrying rods at predetermined distances from the guide rails.

Because the rods are here displaceable on fixed guide rails, a number of garments can be carried by the rods in their storage positions while a rod to receive a garment can be drawn to the opposite side of the support bar, thereby enabling the garment to be hung on this rod without interference by other garments. Conversely, a garment can be removed from a rod drawn toward the opposite side of the support bar without interference.

The garment-carrying rods thus are movable independently of their guide rails and relative to the support bar, but not directly on the support bar but only indirectly with respect to the latter by virtue of the fact that their sliders are shiftable along the guide rails. The support bar, therefore, does not have any elements which project onto the operative side of the hanger to interfere with the emplacement or removal of a guide on or from a rod shifted to that side.

While the guide rails indeed project from the support bar, they do so on the opposite side of the support bar and thus do not pose an interference problem.

The handling of the multiple-garment hanger is, therefore, greatly simplified and facilitated since all of the advantages of the garment hanger with telescopingly arranged garment-carrying rods are maintained, since the garment-carrying rods can be brought into a storage position or into a position for hanging garments or removing them, but in the later position, interference of the type characterizing the earlier system is avoided.

According to a feature of the invention, the guide rails lie in the plane of the support bar and project at right angles to the longitudinal axis of the support bar therefrom. The support bar and guide rails thus define a plane which facilitates the ability of the garments to lie against one another and, upon release of one of the hooks from the closet rod, to hang in a very small space within the wardrobe or closet.

To allow the garment-carrying rods to swing relative to other garment-carrying rods and thereby further facilitate the hanging or removal of individual garments, the invention provides that the guide rail is a round (circular cross section) bar or rod and that the guide bore in the slider receiving the guide rail is also circular. This in an especially simple and reliable manner ensures an effective guidance of the guide-carrying rod on the rail since the slider can swing relative to the guide rail and simultaneously can allow the guide-carrying rod to pivot.

A highly stable arrangement allowing the assembly to hang in an especially compact manner is obtained when the slider has a dog bone shape with heads at opposite ends provided with the guide bore for the guide rail and a hole in which the respective guide-carrying rod is received. As a consequence of this configuration, the lower head of one lider can engage in a recessed portion of an adjacent slider, thereby minimizing the space required for the hanger when the support bar is in its generally upright position.

The central portion of the dog bone-shaped shoulder can be of reduced cross section relative to the heads to permit interfitting of the sliders in the vertically hanging position. This constriction can be formed by having the four sides of the slider concave and curved inwardly so that the cross section of a central portion is rectangular. These concavities are so shaped and dimensioned to allow the head of an adjoining slider to be fully received therein and minimize the overall width of the assembly in its vertical orientation.

The entire hanger, namely, the support bar, the garment-carrying rods, the sliders and the guide rails can be composed of a synthetic resin or plastic for greater slidability, however, it has been found to be advantageous to form the guide rails of a metal, for example, aluminum and the sliders of plastic. As a result, friction of the slider against the guide rail is minimized and, especially where aluminum is used as the metal, the hanger will have light weight, great strength and stability. It is important, of course, to construct the guide rail so that it will not bend under the weight of the garment which is to be mounted on its garment-carrying rod, since a bending of the guide rail will reduce the slidability of the slider therealong.

It has been found to be especially advantageous to form the guide rails and the garment-carrying rods as aluminum tubes and to provide the garment-carrying rods with a coating, reducing the slidability of a garment thereon. The resulting construction is of light weight and has the advantage that the tendency of garments to slip on the rods will be minimized, although the anti-slip coating will not interfere with the slidability of the rod and its slider and, during this sliding motion, the garment will not slip off of the rod.

A pivotal movement of the carrying rod around its guide rail or with respect to the support bar is made possible by the fact that the guide bore in the slider is correspondingly dimensioned and permits such movement. The carrying rod can be caused to remain in a predetermined position by forming the guide bore with inwardly projecting indexing or positioning teeth which can engage the smooth surfaced guide rail and impede a swinging of the slider or its rod thereon. Suspending of the hanger on the closet rod can be facilitated while avoiding the accidental loss of garments from the hanger or compaction of the garments at one end of the respective rod when, according to the invention, the guide rails project from the support bar on the same side of the support bar as that upon which the hooks open.

The guide rails thus form a kind of balancing or guide structure which becomes effective as the hooks are placed around the closet rod. In addition, the closed parts of the hooks are turned toward the side at which the garments are applied or removed and thus cannot interfere with such removal or mounting.

A high degree of space-saving can be obtained when the guide parts between the guide bore and the recess receiving the guide rod is inclined rearwardly and downwardly. With this construction, the lowest part of the slider is located in the plane in which the end stop of the guide rail lies in a highly aesthetic manner. When the hanger is supported on a closet wall or a door, the surface of the door can simultaneously serve as a stop for the rearwardly shifted rod with its slider which can thus lie against the wall.

As a consequence, the multi-garment hanger of the invention is especially easy to handle and user friendly because the removal and application of garments is optimized. The active side of the hanger remains unobstructed by other parts thereof and even the suspending hooks cannot interfere with the hanging or removal of garments.

BRIEF DESCRIPTION OF THE DRAWING

The above objects, features and advantages of my invention will become more readily apparent from the following description, reference being made to the accompanying highly diagrammatic drawing in which.

SPECIFIC INVENTION

Figure 1:
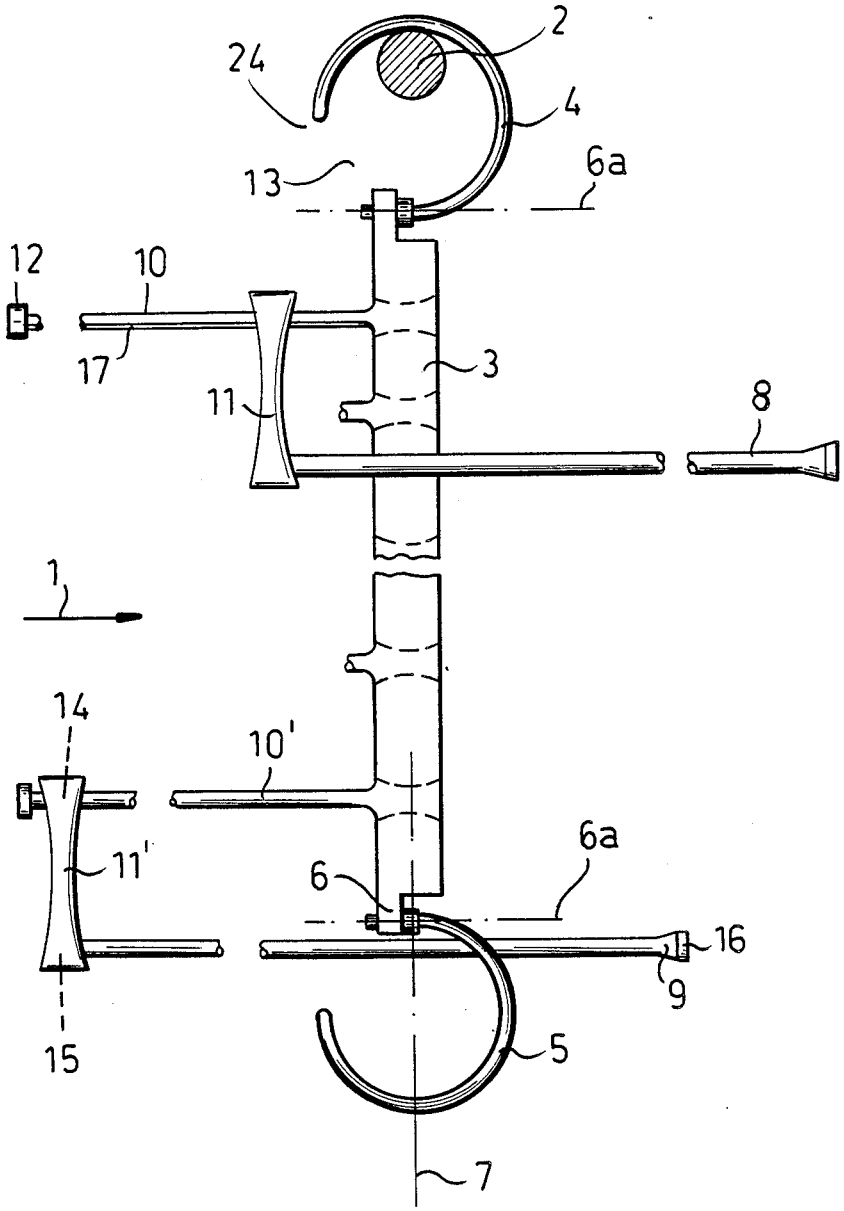
FIG. 1 is a bottom plan view of a multi-garment hanger showing the latter in its position in which it is suspended by only hook from the closet rod.

FIG. 1 shows a multiple-garment hanger 1 without garments and with the garment-carrying rods thereof in different positions.

The multiple-garment hanger 1, in this illustration, is supported by one of its hanging hooks 4 from a closet rod 2 and comprises a support bar 3, frequently referred to as an elongated support herein, which also has another hook 5 at the opposite end of this bar.

The hooks 4 and 5 are swingable via a swivel joint 6 about respective axes 6a perpendicular to the longitudinal axis 7 of the bar 3 through angles in excess of 300° relative to the bar 3. As a consequence, the bar 3 can have two positions in which it can support the garments, namely the position shown in FIG. 1 and the position shown in FIG. 2. In the position shown in FIG. 1, the garments hang in very close proximity to one another and the bar 3 is generally upright, thereby providing a compact storage position. In the position shown in FIG. 2, the garments are spaced along the bar 3.

The support bar 3 is provided with a plurality of spaced apart guide rails 10 which can be circular rods lodged in the bar 3.

These guide rails 10 project from one side of the bar 3, i.e. the left side thereof as seen in FIG. 1, which is the same side as that to which the hooks open at 13.

The support bar 3 carries a plurality of garment-carrying rods 8 and 9 which are shiftable transversely to the longitudinal axis 7 of the support bar 3.

To permit this shifting movement, each of the garment-carrying rods 8, 9 is anchored at one end in a slider 11 which fits around a respective guide rail 10 so that the garment-carrying rods 8 or 9 can be shifted back and forth along these guide rails !0. The end positions of the rods 8, for example, are visible in FIG. 2 and it can be readily seen from a comparison of FIGS. 1 and 2, the rods can be shifted to the right (FIG. 1) for mounting or removing a garment. The rod 9 is approximately in the storage position in the illustration of FIG. 1.

The displacement of the slider 11 and thus of the garment-carrying rods 8 or 9 is defined between an end stop or abutment 12 at the end of each guide rail 10 and the support bar 3. As a consequence, the displacement of the garment-carrying rods 8 or 9 is determined by the length of the respective guide rail 10.

From FIG. 1, it is also apparent that the individual guide rails 10 can be round or can have a sort of step 17 so that the position of the respective garment-carrying rod relative to this guide rail can be precisely determined and swinging of the slider and the rod relative to the guide rail can be prevented.

The fact that the rails 10 project from the same side as the hooks 4 open, also allows the hooks to be applied to the closet rod 2 without interference.

Figure 2:
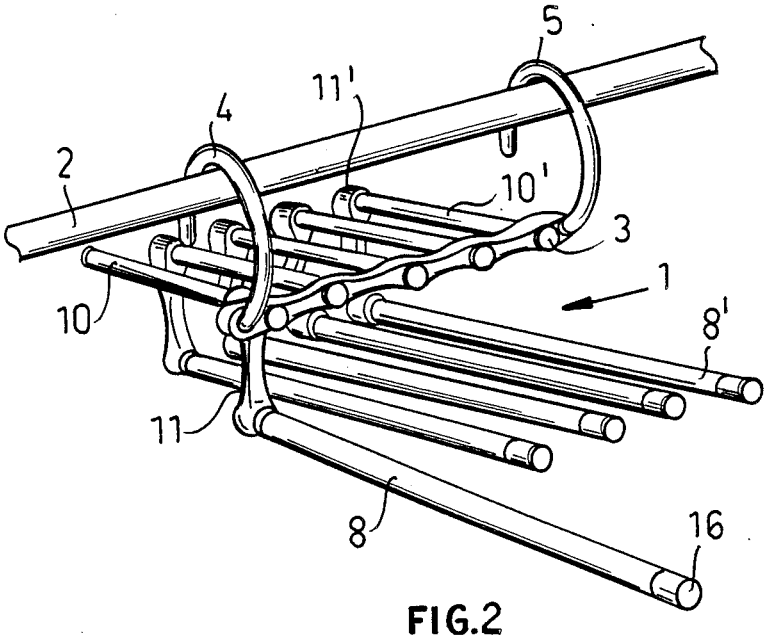
FIG. 2 is a perspective view of the hanger according to the invention supported from the closet rod by both hooks.

As is apparent from both FIGS. 1 and 2, the fact that the rails 10 project on the same side 24 of member 3 as the openings of the hooks 4 and 5 ensures that the free ends of the hooks will not catch on garments with shifting of the rod 8.

If the hooks would be open in the opposite direction, it is possible that the free ends thereof could engage a garment when the rod 8 is shifted to the right for removal.

The guide rails 10, 10' (FIG. 2) can advantageously be aluminum hollow tubes while the slider 11 is composed of plastic so that these two parts can move easily with respect to one another, i.e. without significant friction.

The garment-carrying rod (8 or 8') is lodged in the slider 11 and can be provided with a coating 8a which prevents slip of a garment on the rod. This, of course, will prevent the garments from sliding off the rods 8 or 9 in use.

Figure 3:
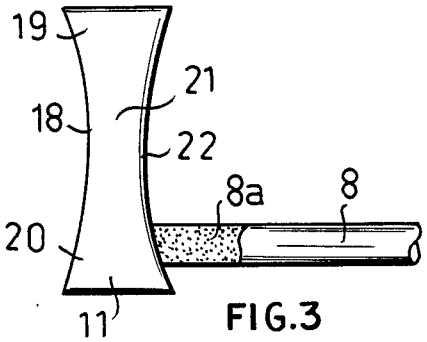
FIG. 3 is a side-elevational view of the garment-carrying rod and its slider.
Figure 4:
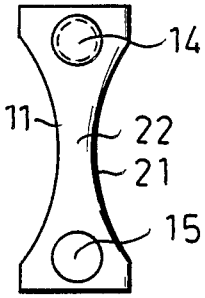
FIG. 4 is an end view thereof.
Figure 5:
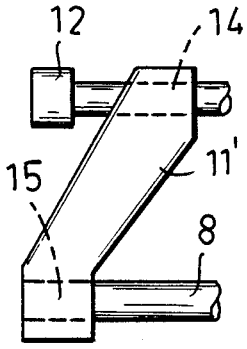
FIG. 5 is a view similar to FIG. 3 illustrating another embodiment of the slider.

FIGS. 3 through 5 show details of the slider 11 or 11', the slider 11, as is especially apparent from FIGS. 3 and 4, of rectangular cross section and dog bone shaped. It thus has head parts 19 and 20 connected by an intermediate part 18. The head part 19 is provided with a guide bore 14 receiving the guide rail 10. The head part 20 has a recess in which the respective garment-carrying rod 8 is lodged. The end stop member 16 on the rods 8 prevent the garment from slipping off the ends of these rods (see FIGS. 1 and 2).

The central portion 18 of the slider 11 is defined by concave arcuate surfaces which minimize the amount of material used in fabrication of the slider and also enable the head of the slider to fit into a concavity of an adjacent slider (as is especially the case with the concavities 21) in the position shown in FIG. 1 and a highly compact construction of the hanger.

In the embodiment of FIG. 5, the slider 11 which otherwise is similar in function and construction to the slider 11, is inclined downwardly and rearwardly so that its lower portion lies directly below the end stop member or abutment 12 of the respective guide rail 10.

Figure 6:
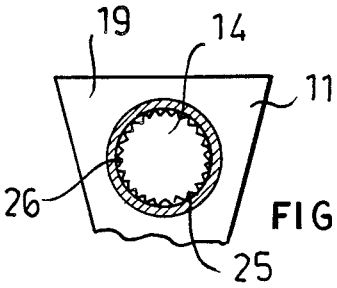
FIG. 6 is an end view of the slider showing the guide bore provided with teeth according to the invention.

FIG. 6 shows that the head part 19 of a slider 11 or 11' can have a guide bore 14 which is internally provided with inwardly projecting positioning teeth 25 and 26 impeding rotation of the guide part 11 or 11' about the guide rail 10.

Theoretically, it is also possible to provide the guide rail 10 with corresponding splines so that a predetermined inclination of the rod 8 with respect to the guide rail 10 can result. As can be seen from FIG. 2, this has the advantage of allowing the rod 8 which is shifted to the right-hand side of the bar 3 to swing away from the other rods and thereby facilitate application of a garment or its removal.

I claim:

1. A multiple-garment hanger, comprising:

an elongated support;

respective hooks connected to opposite ends of said support for suspending said support from a member engageable by at least one of said hooks;

a plurality of guide rails affixed to said support between said hooks and projecting to one side of said support, said guide rails being spaced apart along said support and extending transversely thereto;

a respective slider received on each of said rails and shiftable therealong; and a respective garment-carrying rod affixed to each of said sliders and shiftable therewith relative to the respective guide rail and said support transversely of said support, said garment-carrying rods being spaced from the respective guide rails by the respective sliders.

2. The multiple-garment hanger defined in claim 1 wherein said guide rails are mutually parallel, are coplanar with said support and extend at right angles to a longitudinal axis of said support.

3. The multiple-garment hanger defined in claim 1 wherein said guide rails are bars of round cross section received in respective circular guide bores formed in said sliders.

4. The multiple-garment hanger defined in claim 1 wherein said sliders are generally elongated and transverse to the respective guide rails and rods.

5. The multiple-garment hanger defined in claim 4 wherein each of said sliders is generally dogbone shaped and has heads at opposite ends, one of said heads being respectively formed with a guide bore receiving the respective guide rail and another of said heads of each slider receiving the respective rod.

6. The multiple-garment hanger defined in claim 5 wherein each of said sliders has a central portion of rectangular cross section and defined on four sides by concave curved surfaces of said slider.

7. The multiple-garment hanger defined in claim 1 wherein each of said guide rails is composed of a metal and each of said sliders is composed of a plastic.

8. The multiple-garment hanger defined in claim 7 wherein said metal is aluminum.

9. The multiple-garment hanger defined in claim 1 wherein each of said sliders is formed with a guide bore having inwardly projecting positioning teeth engaging said gide rail.

10. The multiple-garment hanger defined in claim 1 wherein said hooks open toward the same side of said support as the side to which said guide rails extend.

11. The multiple-garment hanger defined in claim 10 wherein said guide rails are mutually parallel, are coplanar with said support and extend at right angles to a longitudinal axis of said support.

12. The multiple-garment hanger defined in claim 11 wherein said guide rails are bars of round cross section received in respective circular guide bores formed in said sliders.

13. The multiple-garment hanger defined in claim 12 wherein said sliders are generally elongated and transverse to the respective guide rails and rods.

14. The multiple-garment hanger defined in claim 13 wherein each of said sliders is generally dogbone shaped and has heads at opposite ends, one of said heads being respectively formed with the said guide bore receiving the respective guide rail and another of said heads of each slider receiving the respective rod.

15. The multiple-garment hanger defined in claim 14 wherein each of said sliders has a central portion of rectangular cross section and defined on four sides by concave curved surfaces of said slider.

16. The multiple-garment hanger defined in claim 15 wherein each of said guide rails is composed of aluminum and each of said sliders is composed of a plastic.

17. The multiple-garment hanger defined in claim 16 wherein said hooks are mounted swingably on said support.

18. The multiple-garment hanger defined in claim 17 wherein each of said guide bores has inwardly projecting positioning teeth engaging the respective guide rail.

19. The multiple-garment hanger defined in claim 13 wherein each of said sliders has an inclined portion between the respective guide rail and rod extending away from said support toward the respective rod.

20. The multiple-garment hanger defined in claim 1 wherein each of said sliders has an inclined portion between the respective guide rail and rod extending away from said support toward the respective rod.

* * * * *